US008172617B2

(12) United States Patent
Peng

(10) Patent No.: US 8,172,617 B2
(45) Date of Patent: May 8, 2012

(54) RF CONNECTOR

(75) Inventor: Chang Lin Peng, Jhonghe (TW)

(73) Assignee: F Time Technology Industrial Co., Ltd., Taipei County (TW)

( * ) Notice: Subject to any disclaimer, the term of this patent is extended or adjusted under 35 U.S.C. 154(b) by 190 days.

(21) Appl. No.: 12/753,493

(22) Filed: Apr. 2, 2010

(65) Prior Publication Data

US 2011/0244720 A1 Oct. 6, 2011

(51) Int. Cl.
*H01R 13/66* (2006.01)

(52) U.S. Cl. ..... 439/620.03; 439/188; 439/944

(58) Field of Classification Search ..... 439/620.21, 439/620.03, 188, 944; 200/51.1
See application file for complete search history.

(56) References Cited

U.S. PATENT DOCUMENTS 2,640,118 A * 5/1953 Werner ..... 333/22 R
3,946,390 A * 3/1976 Alexander et al. ..... 343/702
3,960,428 A * 6/1976 Naus et al. ..... 439/315
5,562,464 A * 10/1996 Lecourtois ..... 439/188
5,904,579 A * 5/1999 McLean et al. ..... 439/63
5,936,581 A * 8/1999 Roshitsh et al. ..... 343/702
6,106,314 A * 8/2000 McLean et al. ..... 439/188
6,547,592 B2 * 4/2003 Boillot ..... 439/578
6,688,916 B1 * 2/2004 Lee ..... 439/620.03
6,872,091 B2 * 3/2005 Huang ..... 439/578
7,168,980 B2 * 1/2007 Peng ..... 439/580
7,416,444 B1 * 8/2008 Lin ..... 439/578
7,632,121 B2 * 12/2009 Gonzales et al. ..... 439/188
7,819,680 B2 * 10/2010 Hoyack et al. ..... 439/188

* cited by examiner

*Primary Examiner* — Tulsidas C Patel
*Assistant Examiner* — Travis Chambers
(74) *Attorney, Agent, or Firm* — Guice Patents PLLC

(57) ABSTRACT

A radio-frequency connector consisting of a socket member and a plug member electrically connectable to the socket member is disclosed. The socket member or plug member has an impedance element mounted therein such that the impedance element is electrically connected to the metal casing and metal center pin of the socket member or plug member that carries the impedance element when the plug member is disconnected from the socket member, causing the impedance element to provide a terminal effect to insolate external electromagnetic noises; the impedance element is separated from the metal casing and metal center pin of the socket member or plug member that carries impedance element when the plug member is connected to the socket member.

16 Claims, 12 Drawing Sheets

RF CONNECTOR

BACKGROUND OF THE INVENTION

1. Field of the Invention

The present invention relates to RF connectors and more particularly, to a socket or plug type of RF connector that has an impedance element mounted therein to eliminate electromagnetic disturbance.

2. Description of the Related Art

In communication technology, electromagnetic disturbance can jam sensitive equipment, burn out electric circuits, prompt explosions, interrupts, obstructs, or otherwise degrades or limits the effective performance of electronics or electrical equipment. Electromagnetic disturbance can be any object, artificial or natural, that carries rapidly changing electrical currents, or induced unintentionally, as a result of spurious emissions and responses, intermodulation products, and the like. Radiation leak from a transmission medium is mainly resulted from the use of high-frequency energy and signal modulation. Using a proper shield can reduce electromagnetic disturbance.

In a communication equipment, a RF connector must be used to connect a signal-carrying coaxial cable to a circuit board in the equipment, or to another coaxial cable. A RF connector consists of a socket member and a plug member. After removal of the socket member from the plug member, the socket member may be interfered by external electromagnetic noises. This electromagnetic interference must be eliminated.

SUMMARY OF THE INVENTION

The present invention has been accomplished under the circumstances in view. It is one object of the present invention to provide a RF connector, which effectively eliminates electromagnetic interference.

To achieve this and other objects of the present invention, a RF connector comprises a socket member and a plug member electrically connectable to the socket member. The socket member or plug member has an impedance element mounted therein such that the impedance element is electrically connected to the metal casing and metal center pin of the socket member or plug member that carries the impedance element when the plug member is disconnected from the socket member, causing the impedance element to provide a terminal effect to isolate external electromagnetic noises; the impedance element is separated from the metal casing and metal center pin of the socket member or plug member that carries impedance element when the plug member is connected to the socket member.

Further, the impedance element can have a rod-shaped or strip-shaped configuration.

Further, the socket member can be an F-type connector, end board F-type connector, F-type coaxial cable connector, MCX-type connector, N-type connector, SMA-type connector, end board SMA-type connector, PAL-type connector, or end board PAL-type connector.

DETAILED DESCRIPTION OF THE PREFERRED EMBODIMENT

Figure 1:
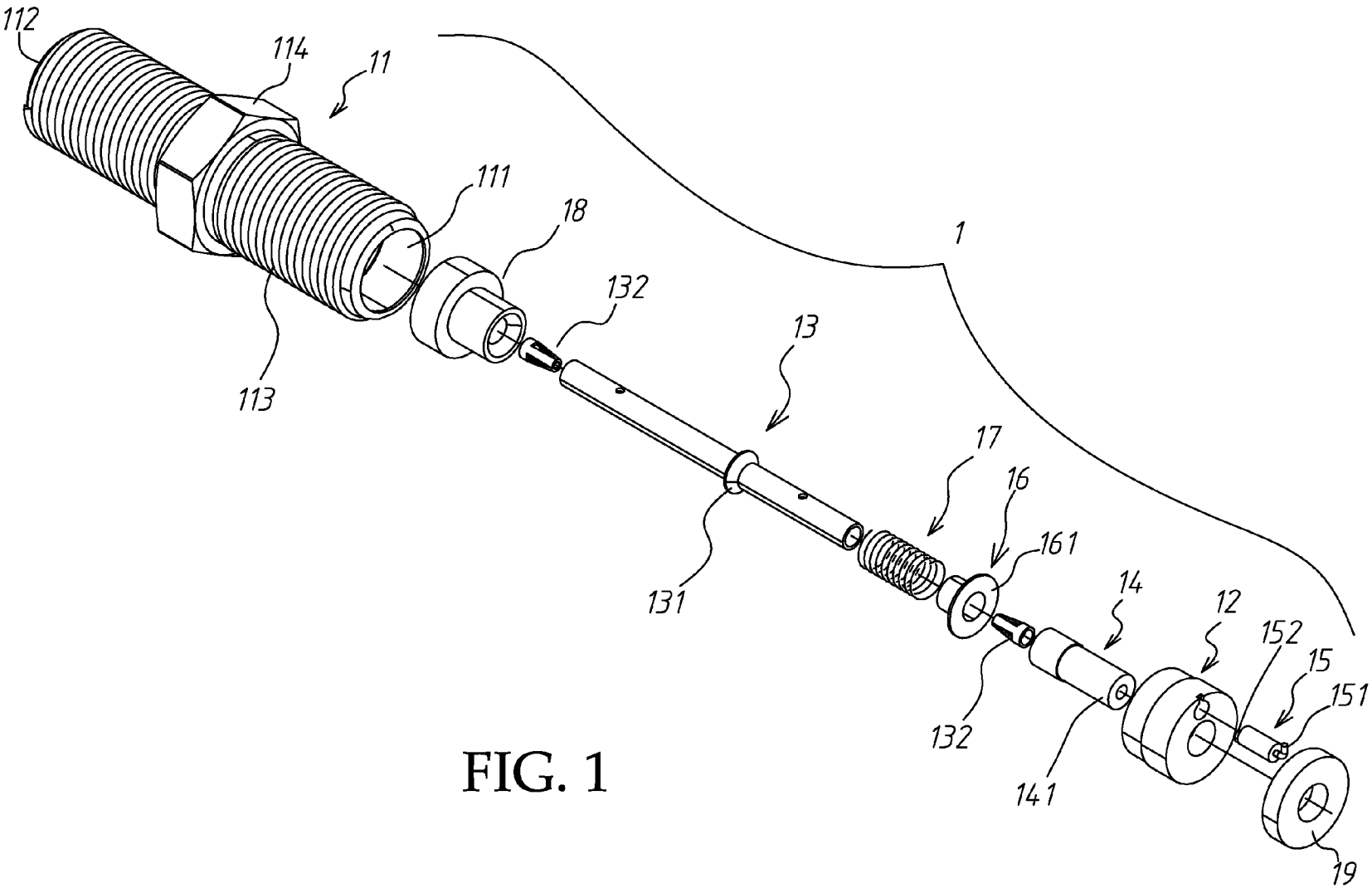
FIG. 1 is an exploded view of an F-type socket member for RF connector in accordance with the present invention.
Figure 2:
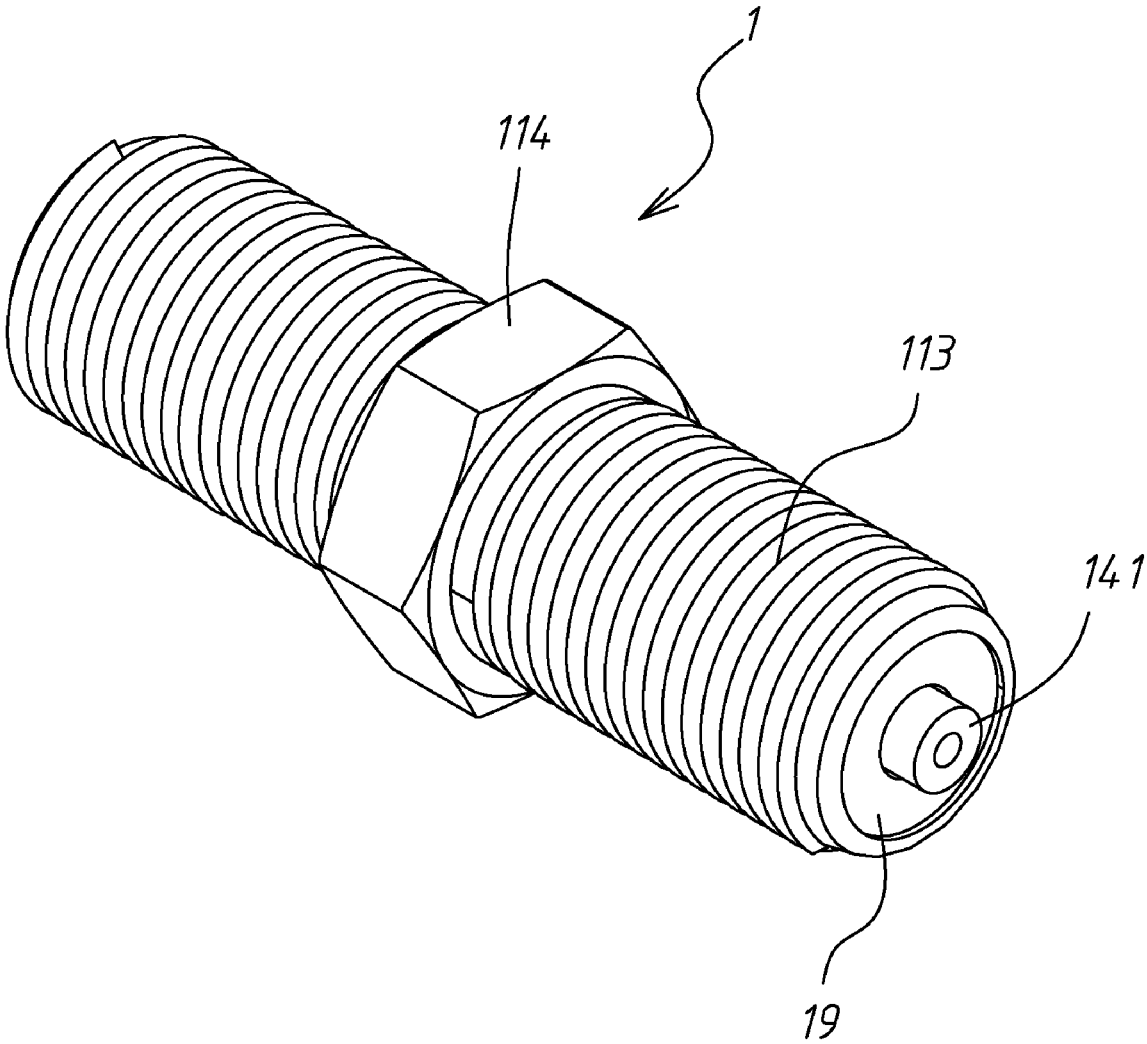
FIG. 2 is an elevational assembly view of the F-type socket member shown in FIG. 1.

Referring to FIG. 1, an F-type socket member 1 for RF connector in accordance with the present invention is shown comprising a metal casing 11, an internal insulation member 12, a metal center pin 13, a front insulation member 14, an impedance element 15, a metal contact sleeve 16 and an elastic member 17.

The metal casing 11 is a hollow cylindrical member, having a front opening 111 and a rear opening 112. The front opening 111 is adapted for receiving a plug member 2 (see FIG. 4). The metal casing 11 has outer threads 113 extending around the periphery thereof and a nut 114 located on the middle part around the periphery.

Figure 3:
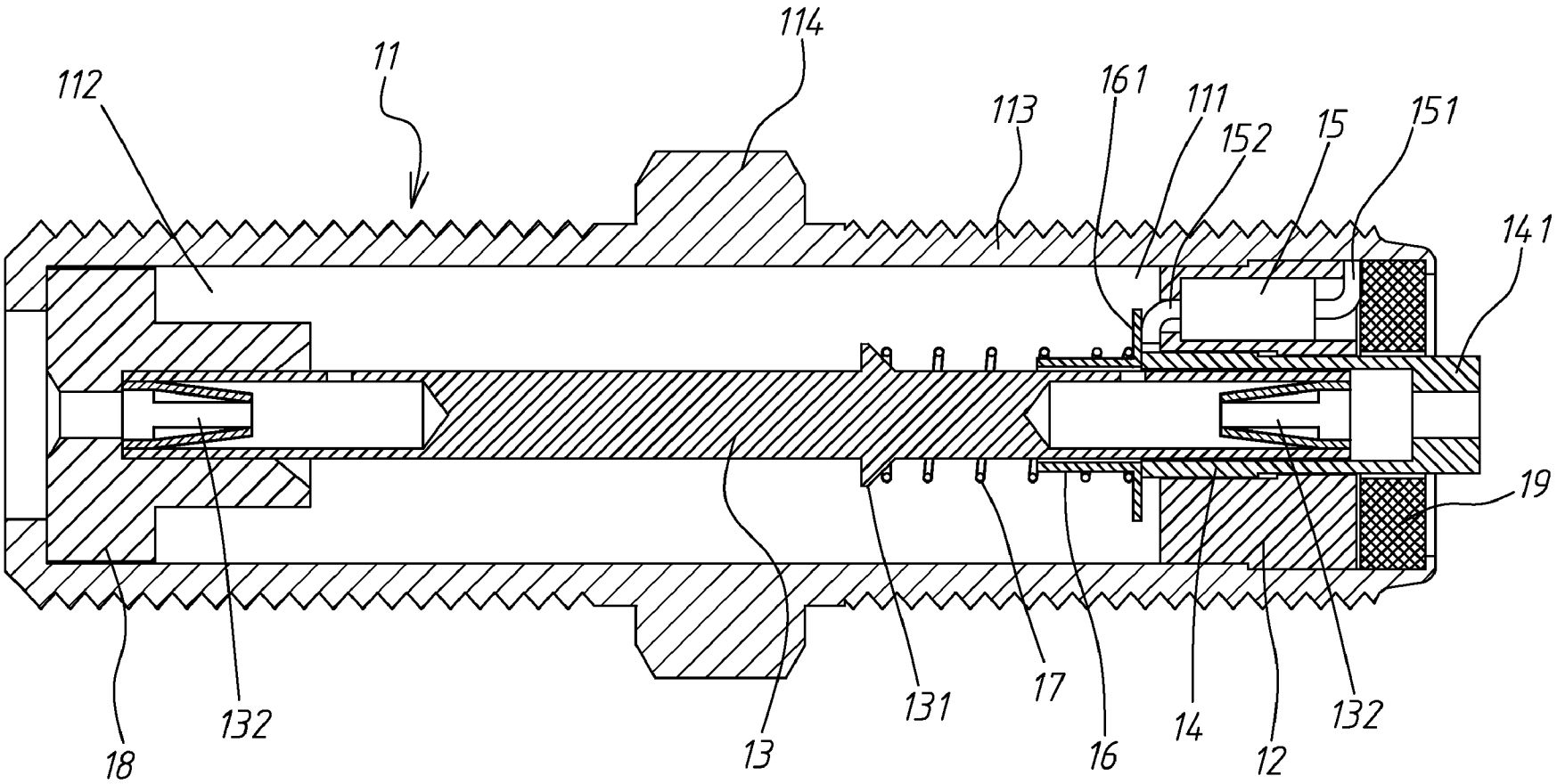
FIG. 3 is a sectional view of the F-type socket member shown in FIG. 2.

As shown in FIG. 3, the internal insulation member 12 is mounted inside the metal casing 11. The metal center pin 13 is axially mounted in the metal casing 11 at the center and inserted through the internal insulation member 12. The front end of the center pin 13 is electrically connected to the metal center pin 21 of the inserted plug member 2, as shown in FIG. 4.

The front insulation member 14 is movably mounted in the front opening 111 of the metal casing 11 and sleeved onto the metal center pin 13. Insertion of the plug member 2 into the F-type socket member 1 causes the front insulation member 14 to be moved axially.

The impedance element 15 is mounted in the metal casing 11, having a first end 151 and an opposing second end 152. The metal contact sleeve 16 is electrically conductively sleeved onto the metal center pin 13 and movable with the front insulation member 14. Further, the elastic member 17 can be a spring member adapted for returning the front insulation member 14 after the front insulation member 14 having been moved.

Figure 4:
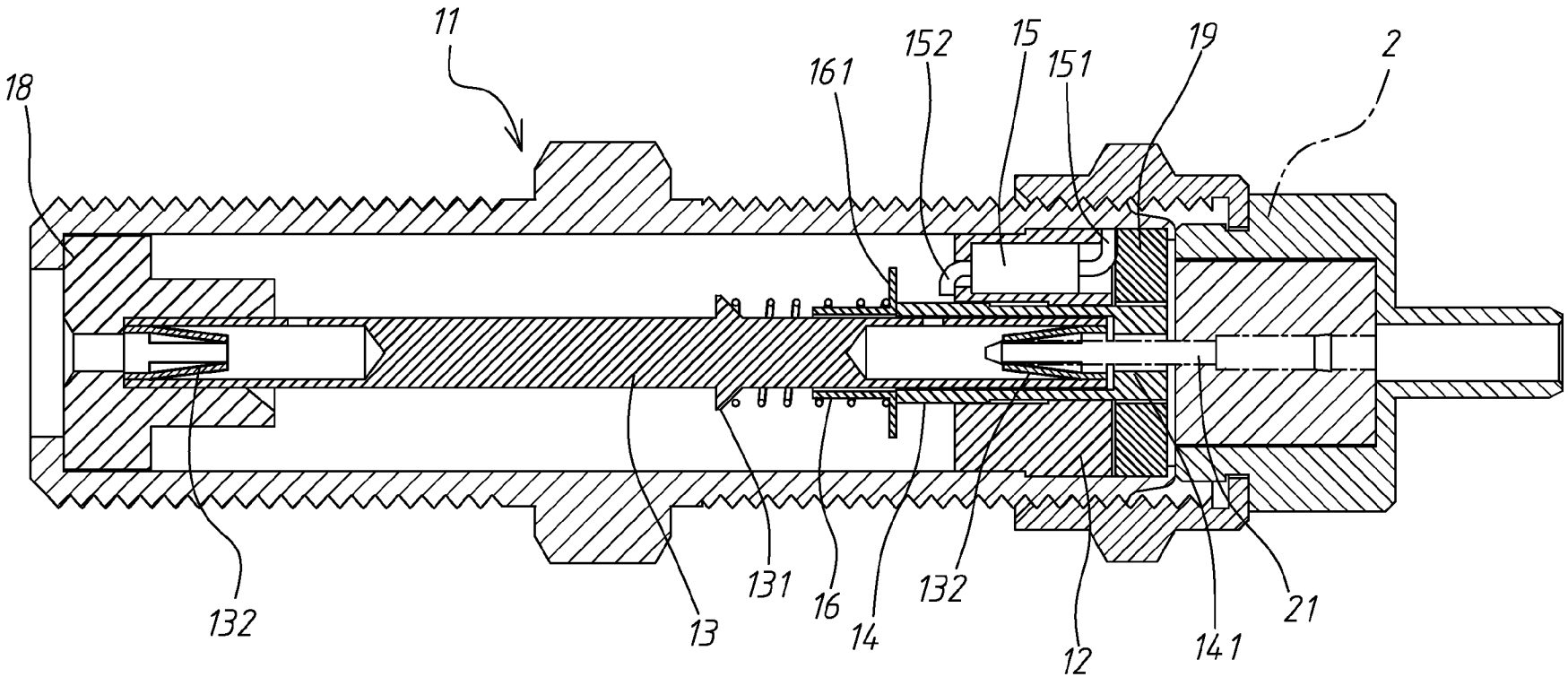
FIG. 4 corresponds to FIG. 3, showing an F-type plug member connected thereto.

Referring to FIGS. 3 and 4, before insertion of the plug member 2 into the F-type socket member 1 (see FIG. 3), the first end 151 and second end 152 of the impedance element 15 are respectively electrically kept in contact with the metal casing 11 and the metal contact sleeve 16. Thus, the impedance element 15 provides a terminal effect to isolate external electromagnetic noises. Upon insertion of the plug member 2 into the F-type socket member 1 (see FIG. 4), the front insulation member 14 and the metal contact sleeve 16 are forced to displace, thereby disconnecting the first end 151 or second end 152 of the impedance element 15 from the metal casing 11 or the metal contact sleeve 16, and therefore the terminal effect of the impedance element 15 is disappeared.

In the embodiment shown in FIGS. 1~4, the internal insulation member 12 is mounted in the front opening 111 of the metal casing 11. Further, a rear insulation member 18 is mounted in the rear opening 112 of the metal casing 11. Thus, the metal center pin 13 is supported between the front insulation member 12 and the rear insulation member 18. Further, the impedance element 15 is rod-shaped.

The metal center pin 13 has a collar 131 extending around the periphery and stopped against one end of the elastic member 17. The elastic member 17 has its other end stopped against an expanded end face 161 at one end of the metal contact sleeve 16. Further, the two distal ends of the metal center pin 13 are respectively mounted with a respective clamping member 132 for securing the metal center pin 21 of the inserted plug member 2 positively.

The front opening 111 of the metal casing 11 is blocked by a copper ring 19. Further, the front insulation member 14 has a front extension portion 141 inserted through the copper ring 19 to the outside. The impedance element 15 is eccentrically embedded in the internal insulation member 12 with the first end 151 and second end 152 thereof respectively electrically kept in contact with the copper ring 19 and the expanded end face 161 of the metal contact sleeve 16.

According to this embodiment, the front insulation member 14 is inserted through the center of the internal insulation member 12. Upon insertion of the plug member 2, the front insulation member 14 is forced to move the expanded end face 161 of the metal contact sleeve 16 against the elastic member 17, separating the second end 152 of the impedance element 15 from the expanded end face 161 of the metal contact sleeve 16.

Figure 5:
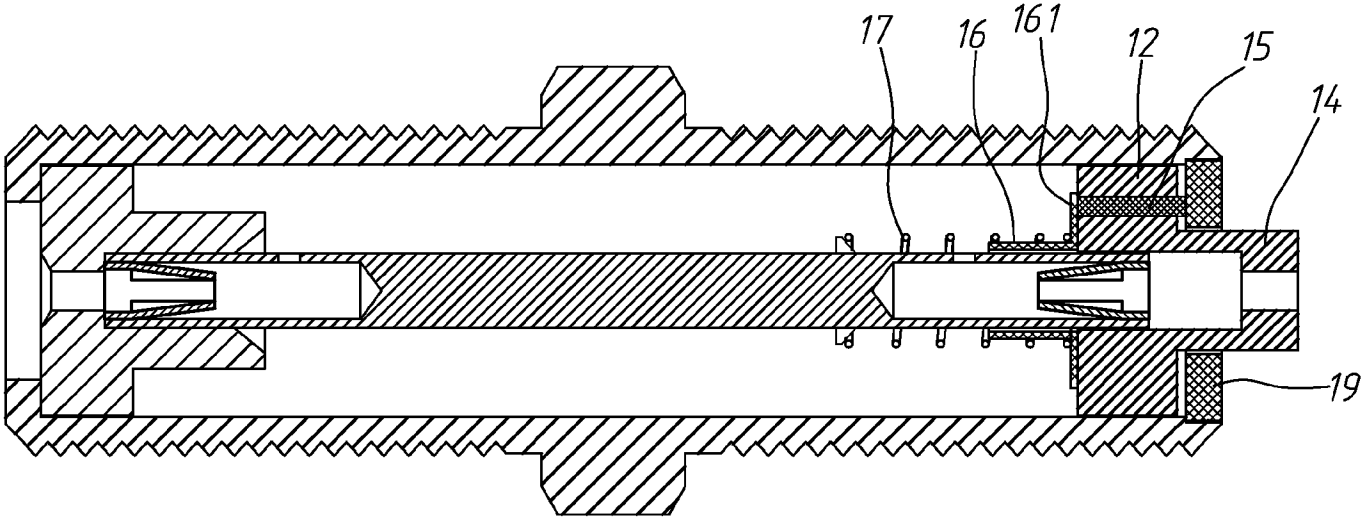
FIG. 5 is a sectional view of an alternate form of the F-type socket member in accordance with the present invention, showing the front insulation member formed integral with the internal insulation member.
Figure 6:
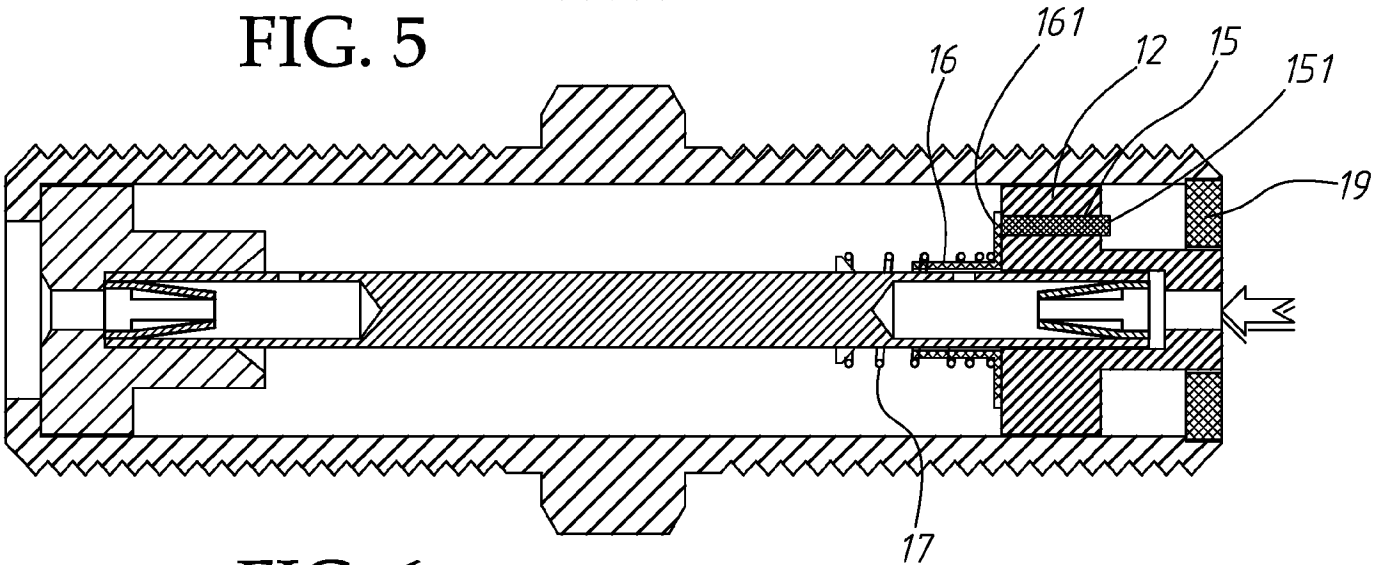
FIG. 6 corresponds to FIG. 5, showing an F-type plug member connected thereto.

In the embodiment shown in FIGS. 5 and 6, the impedance element 15 is a flat member; the front insulation member 14 and the internal insulation member 12 are integrally made in a single piece. Upon insertion of the plug member 2 (see FIG. 6), the front insulation member 14 is forced to move the expanded end face 161 of the metal contact sleeve 16 and the internal insulation member 12 against the elastic member 17, separating the first end 151 of the impedance element 15 from the copper ring 19.

Figure 7:
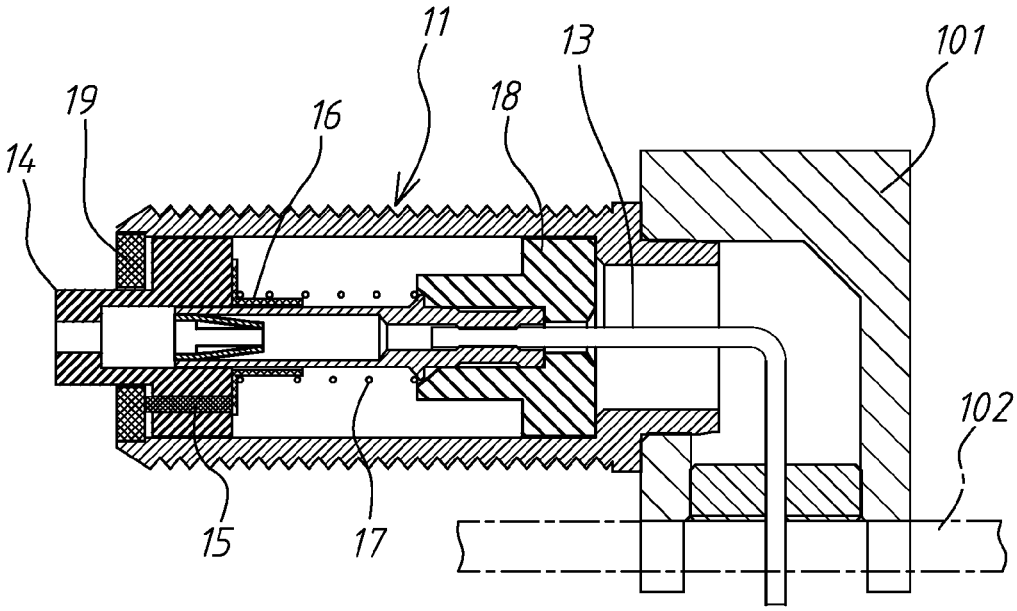
FIG. 7 is a sectional view of another alternate form of the F-type socket member for installation in a board member in accordance with the present invention.
Figure 8:
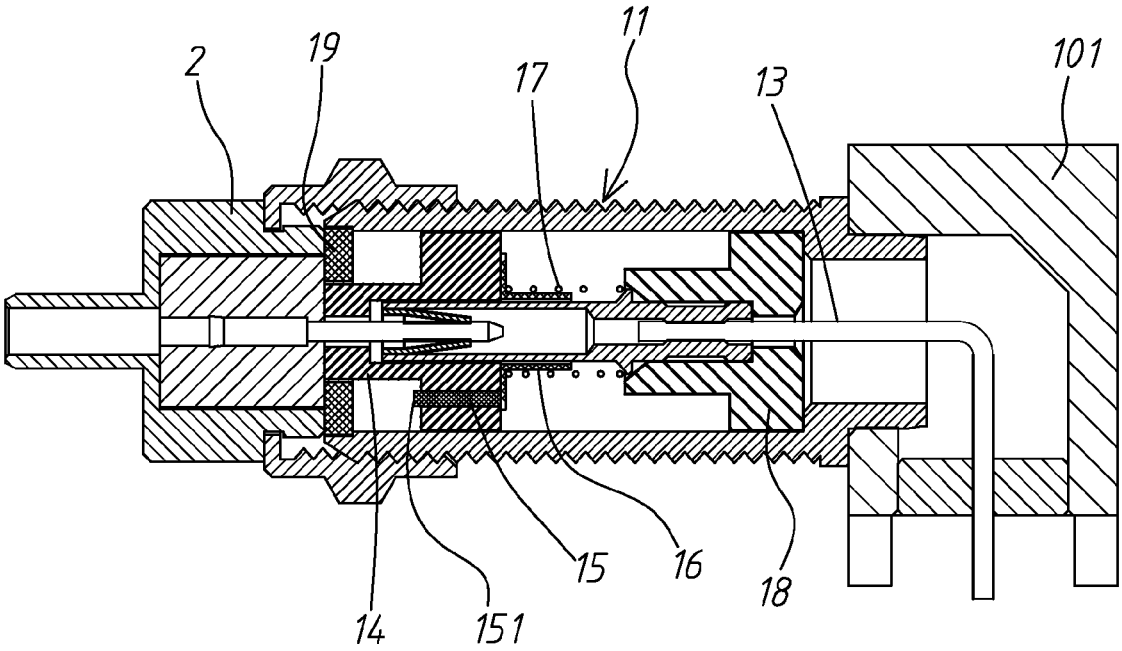
FIG. 8 corresponds to FIG. 7, showing an F-type plug member connected thereto.

The embodiment shown in FIGS. 7 and 8 is substantially similar to that shown in FIG. 6 with the exception that the rear end of the metal casing 11 is connected to a board member connection device 101; the metal center pin 13 has its rear end curved for installation in a circuit board 102. As shown in FIG. 8, when a matching plug member 2 is inserted, the front insulation member 14 is forced to move the first end 151 of the impedance element 15 from the copper ring 19.

Figure 9:
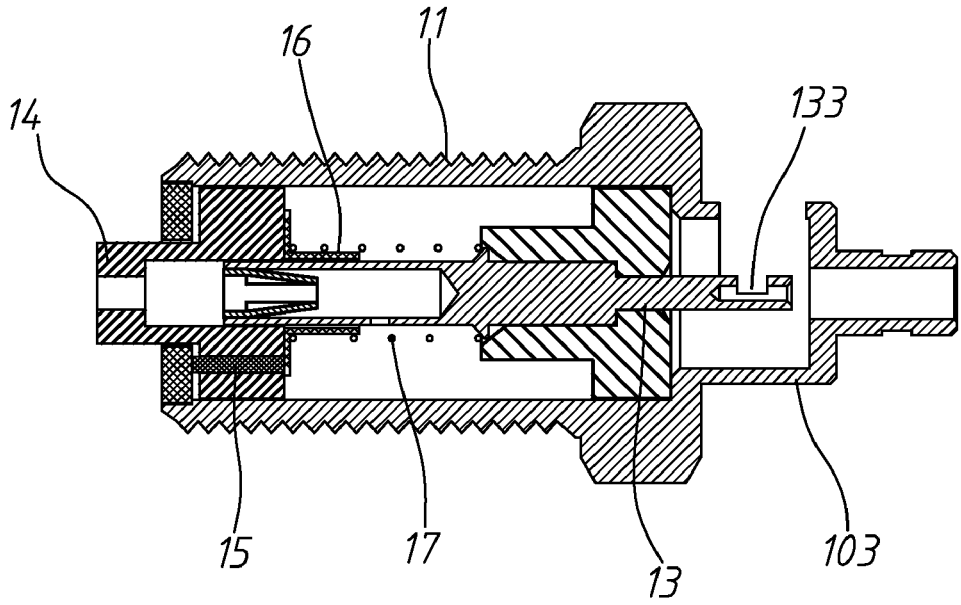
FIG. 9 is a sectional view of still another alternate form of the F-type socket member for installation in a coaxial cable in accordance with the present invention.
Figure 10:
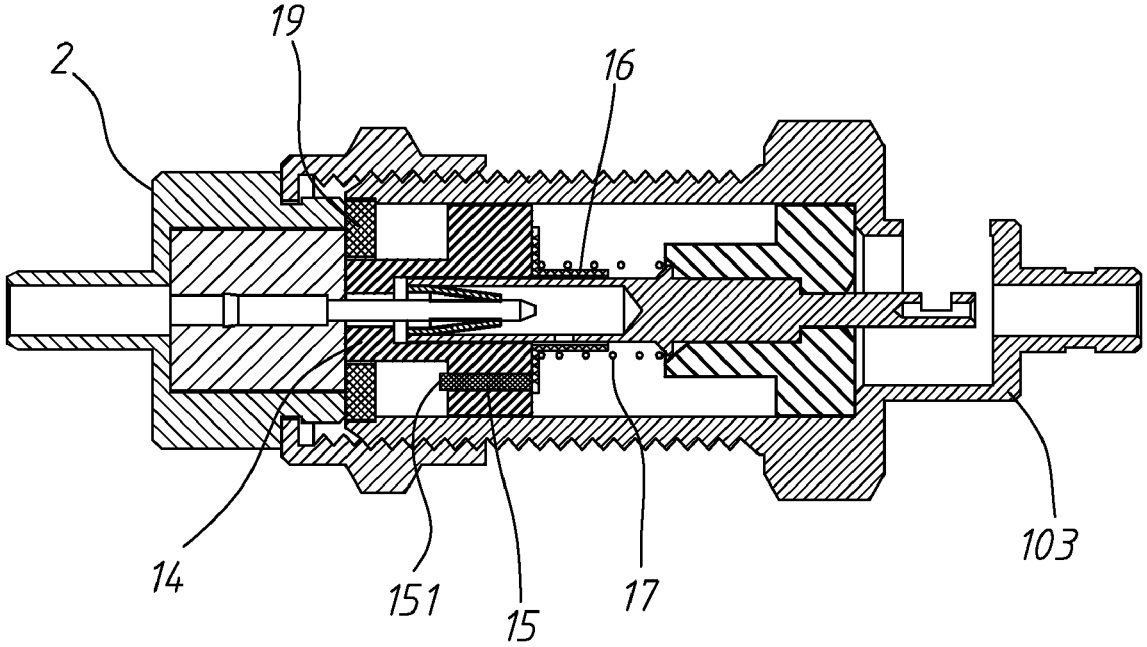
FIG. 10 corresponds to FIG. 9, showing an F-type plug member connected thereto.

The embodiment shown in FIGS. 9 and 10 is substantially similar to that shown in FIG. 6 with the exception that the rear end of the metal casing 11 is terminating in a coaxial cable guide portion 103 for receiving a coaxial cable; the metal center pin 13 has its rear end terminating in a retaining portion 133 for securing a coaxial cable (not shown). As shown in FIG. 10, when a matching plug member 2 is inserted, the front insulation member 14 is forced to move the first end 151 of the impedance element 15 from the copper ring 19.

Figure 11:
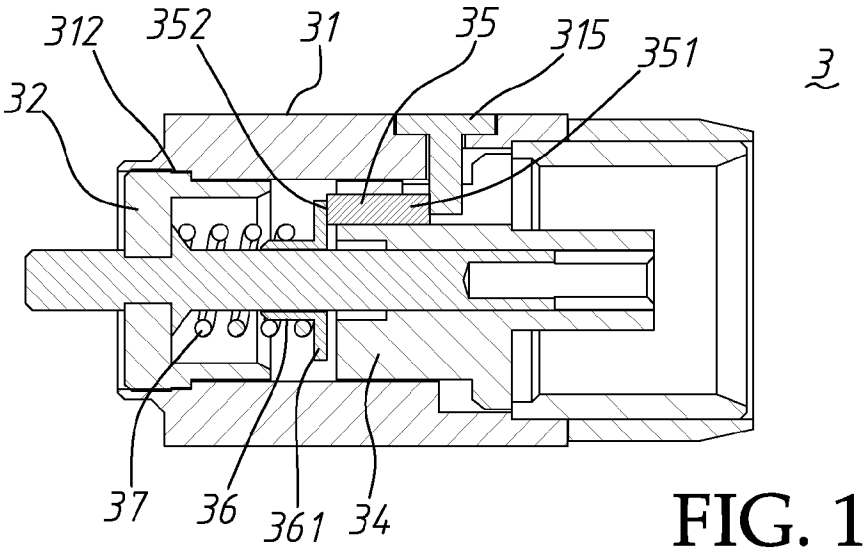
FIG. 11 is a sectional view of a MCX-type socket member for RF connector in accordance with the present invention.
Figure 12:
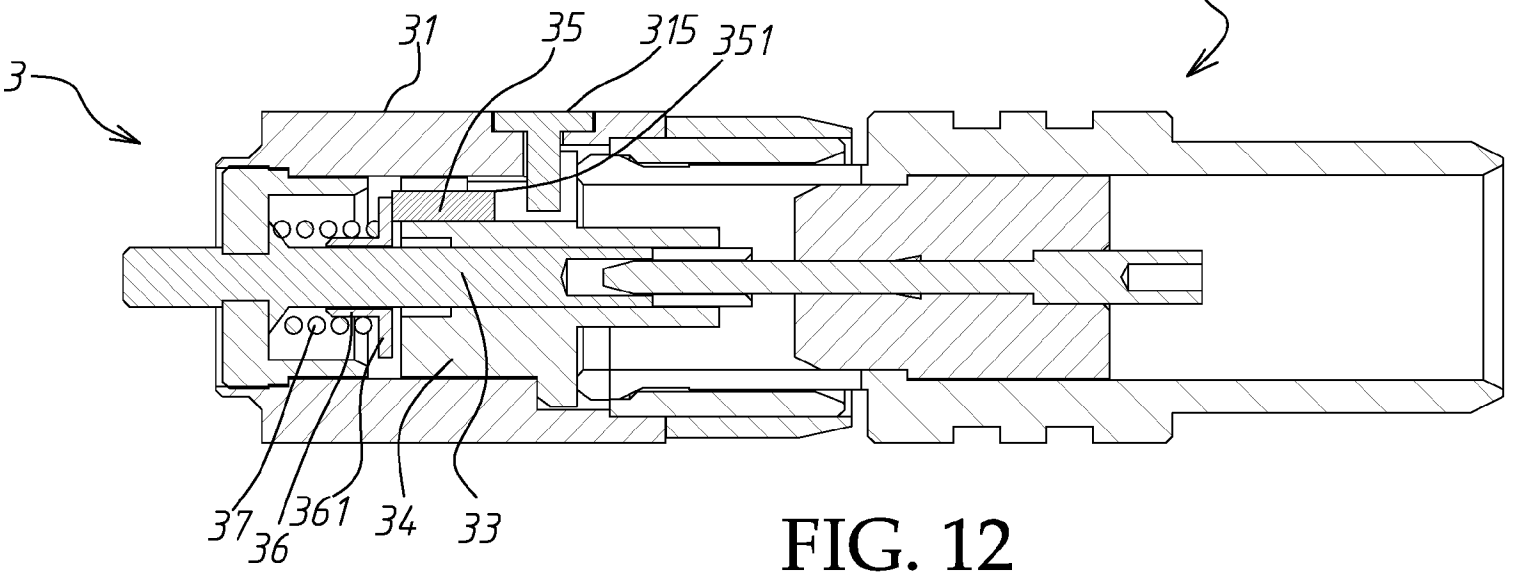
FIG. 12 corresponds to FIG. 11, showing a MCX-type plug member connected thereto.

FIGS. 11 and 12 illustrate a MCX-type socket member 3 for RF connector in accordance with the present invention. According to this embodiment, a metal T-type element 315 is perpendicularly inserted into the inside of the metal casing 31 of the MCX-type socket member 3. The impedance element 35 is horizontally embedded in the front insulation member 34, having the first end 351 thereof electrically connected to the metal T-type element 315, and therefore the impedance element 35 is electrically connected to the metal casing 31. The second end 352 of the impedance element 35 extends out of the front insulation member 34 and kept in contact with the expanded end face 361 of the metal contact sleeve 36.

The internal insulation member 32 is mounted in the rear opening 312 of the metal casing 31. The elastic member 37 is sleeved onto the metal center pin 33 and set between the internal insulation member 32 and the expanded end face 361 of the metal contact sleeve 36.

As shown in FIG. 12, when inserting a plug member 2 into the MCX-type socket member 3, the front insulation member 34 is moved on the metal center pin 33 to push the expanded end face 361 of the metal contact sleeve 36 against the elastic member 37, causing separation of the first end 351 of the impedance element 35 from the metal T-type element 315, and therefore the impedance element 35 is disconnected from the metal casing 31.

Figure 13:
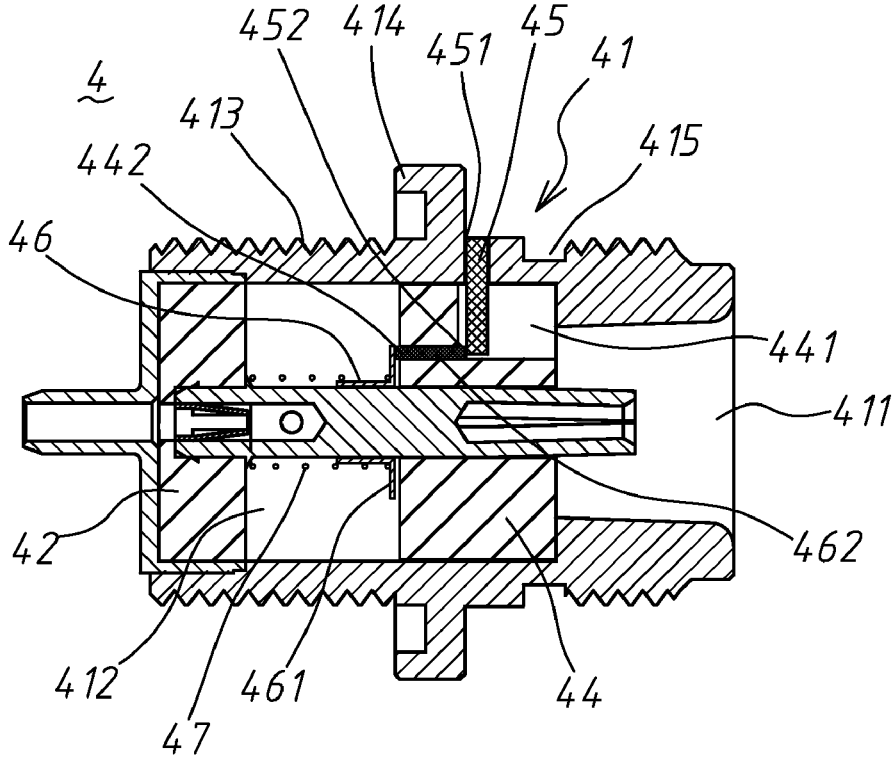
FIG. 13 is a sectional view of an N-type socket member for RF connector in accordance with the present invention.
Figure 14:
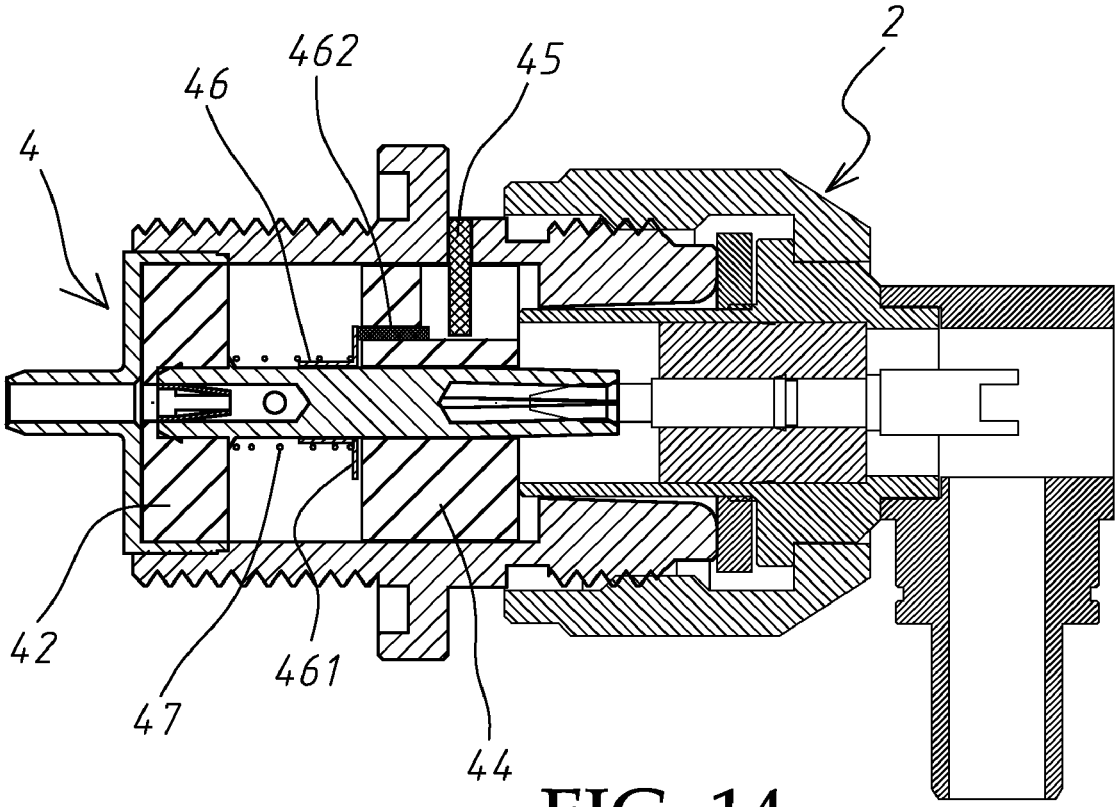
FIG. 14 corresponds to FIG. 13, showing an N-type plug member connected thereto.

FIGS. 13 and 14 illustrate an N-type socket member 4 for RF connector in accordance with the present invention. According to this embodiment, the metal casing 41 has threads 413 extending around the periphery, a grooved nut 414 located on the middle part around the periphery, and a locating groove 415 extending around the periphery at a suitable location.

The impedance element 45 is perpendicularly embedded in the metal casing 41, having the first end 451 thereof electrically connected to the metal casing 41. The front insulation member 44 has a cut 441 extended from the periphery toward the center for accommodating the second end 452 of the impedance element 45, and a through hole 442 extended from the cut 441 at right angles. The metal contact sleeve 46 has the expanded end face 461 thereof kept in contact with the inner side of the front insulation member 44, and a protruding strip 462 extended from the expanded end face 461 and engaged into the through hole 442 and kept in contact with the second end 452 of the impedance element 45.

The internal insulation member 42 is mounted in the rear opening 412 of the metal casing 41. The elastic member 47 is set between the internal insulation member 42 and the expanded end face 461 of the metal contact sleeve 46.

Referring to FIG. 14, when inserting a plug member 2 into the N-type socket member 4, the front insulation member 44 is forced to push the expanded end face 461 of the metal contact sleeve 46 against the elastic member 47, causing separation of the second end 452 of the impedance element 45 from the protruding strip 462 of the metal contact sleeve 46.

Figure 15:
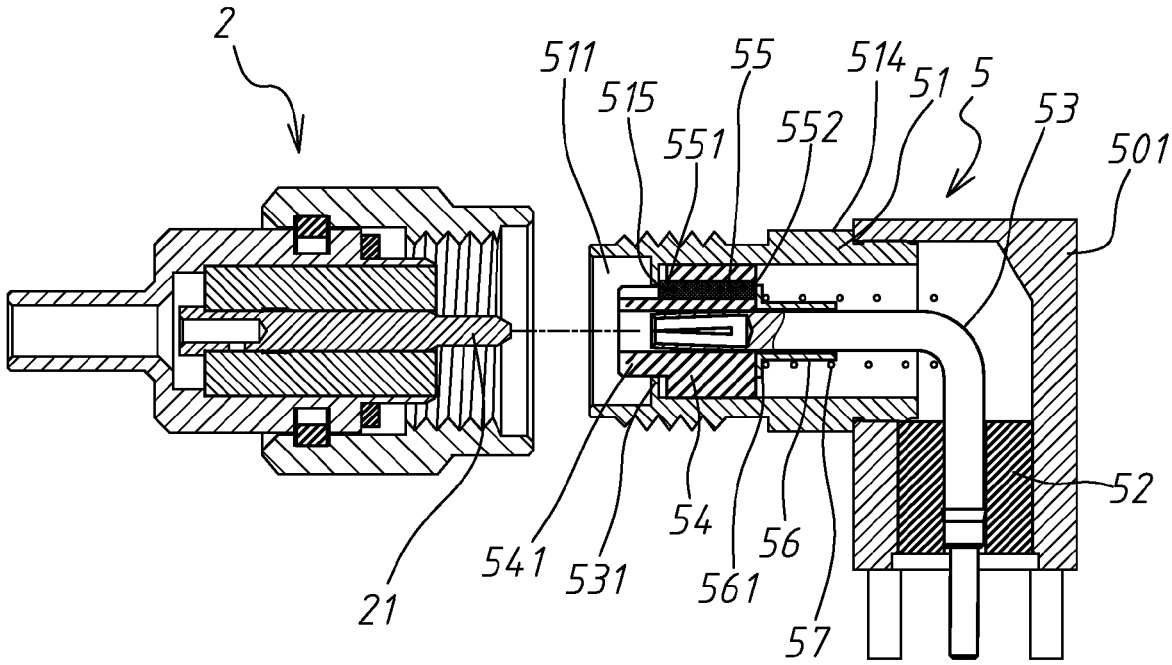
FIG. 15 is a sectional view of a SMA-type socket member for RF connector in accordance with the present invention.
Figure 16:
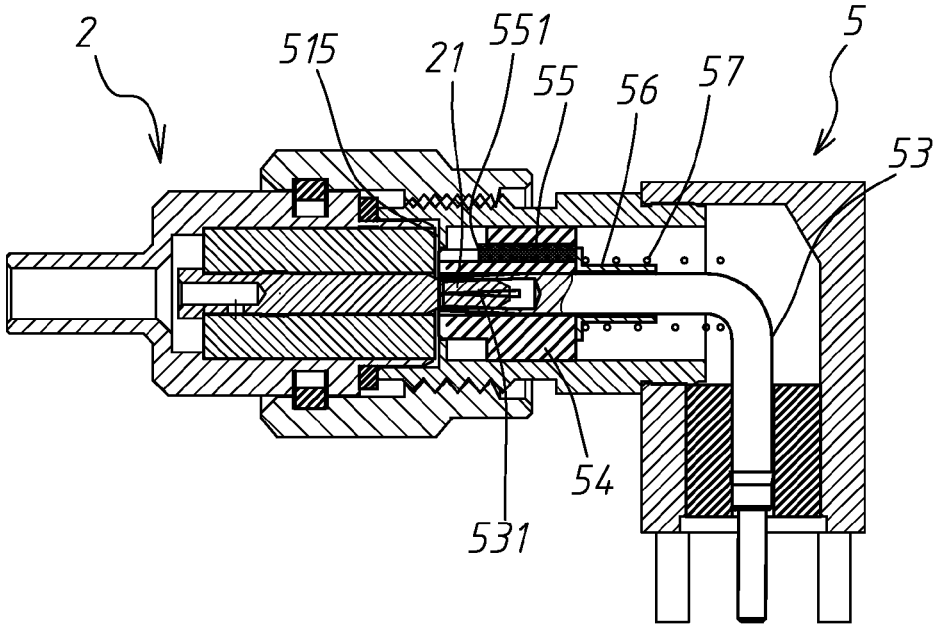
FIG. 16 corresponds to FIG. 15, showing a SMA-type plug member connected thereto.

FIGS. 15 and 16 illustrate a SMA-type socket member 5 for RF connector in accordance with the present invention.

According to this embodiment, a board member connection device 501 is connected to the rear side of the metal casing 51 and stopped at the rear side of the nut 514 that is located on the periphery of the metal casing 51. The metal casing 51 has an inside annular flange 515 extending around the inside wall of the front opening 511 for stopping the front insulation member 54. The metal center pin 53 is angled. The internal insulation member 52 is mounted in the rear open side of the board member connection device 501.

The front insulation member 54 has a front extension 541 inserted through the inside annular flange 515 of the metal casing 51. The impedance element 55 is horizontally mounted in the front insulation member 54 at an eccentric location, having the first end 551 thereof electrically connected to the inside annular flange 515 of the metal casing 51. The metal contact sleeve 56 has its expanded end face 561 stopped against the inner side of the front insulation member 54. The expanded end face 561 of the metal contact sleeve 56 is kept in contact with the second end 552 of the impedance element 55. The elastic member 57 is sleeved onto the horizontal segment of the angled metal center pin 53 and stopped against the expanded end face 561 of the metal contact sleeve 56.

The front end 531 of the metal center pin 53 is shaped like an axially split clamp. When a plug member 2 is inserted into the SMA-type socket member 5, the pointed front end of the metal center pin 21 of the plug member 2 is engaged into the axially split clamp-shaped front end 531 of the metal center pin 53, as shown in FIG. 16, and at this time the front insulation member 54 is moved to push the expanded end face 561 of the metal contact sleeve 56 against the elastic member 57, thereby disengaging the first end 551 of the impedance element 55 from the inside annular flange 515 of the metal casing 51.

Figure 17:
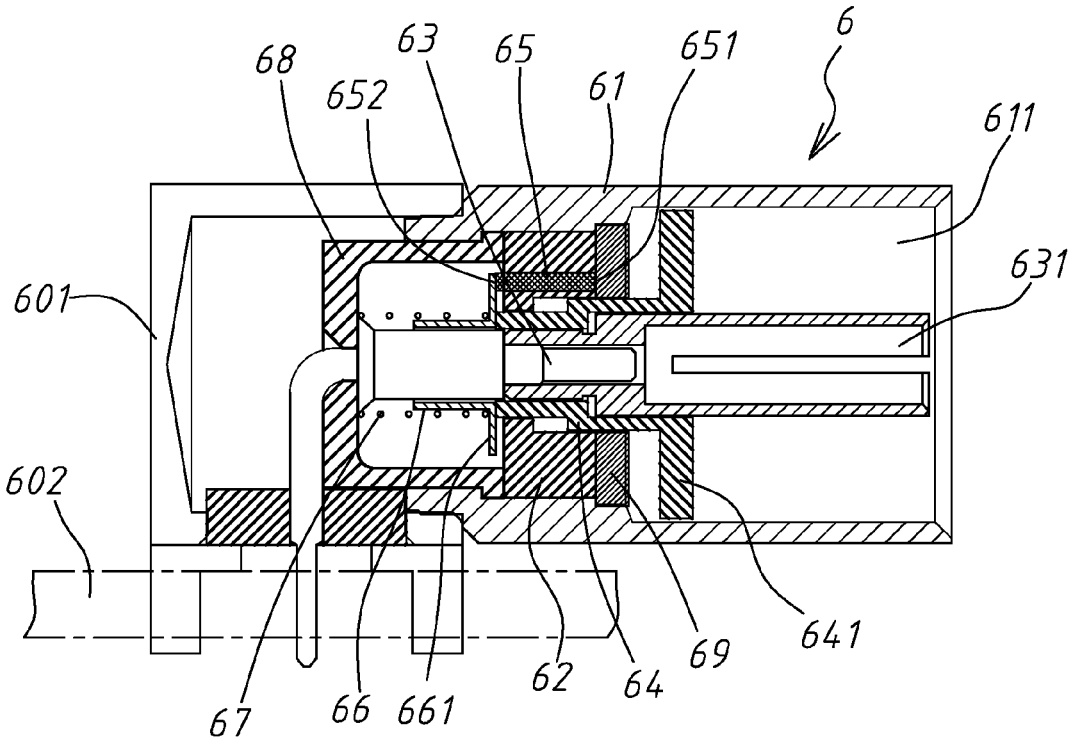
FIG. 17 is a sectional view of a PAL-type socket member for RF connector in accordance with the present invention.
Figure 18:
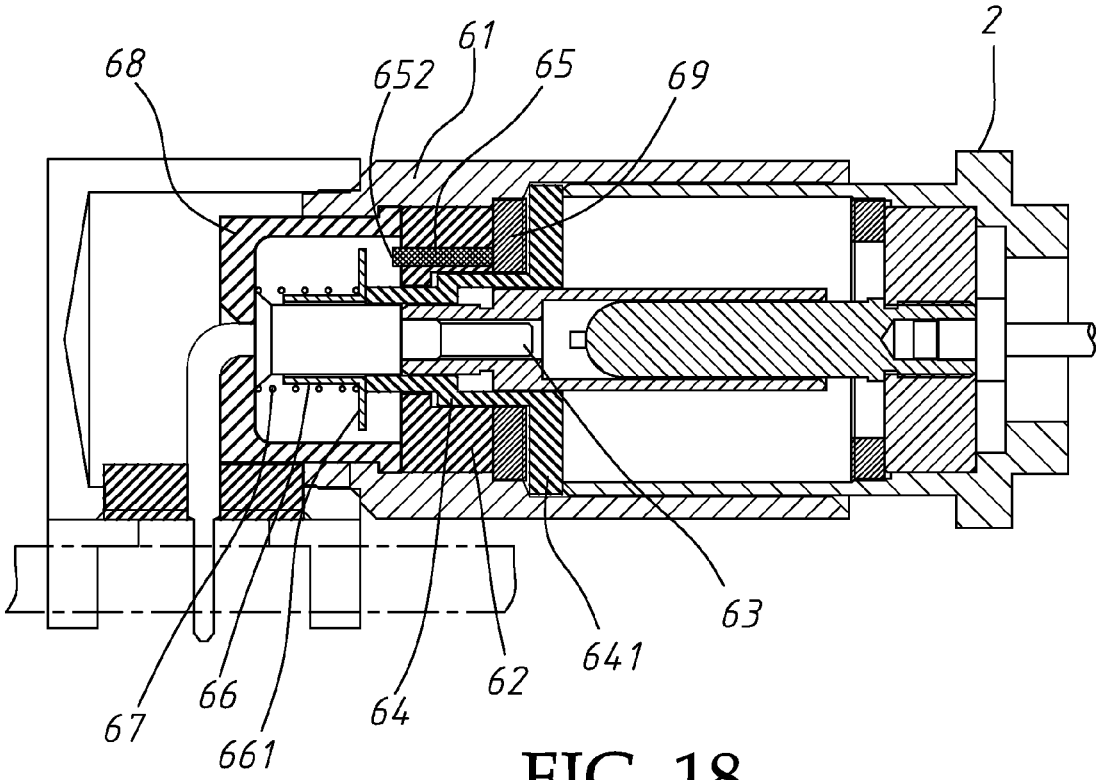
FIG. 18 corresponds to FIG. 17, showing a PAL-type plug member connected thereto.

FIGS. 17 and 18 illustrate a PAL-type socket member 6 for RF connector in accordance with the present invention. According to this embodiment, a board member connection device 601 is connected to the rear side of the metal casing 61. The board member connection device 601 has a rear insulation member 68 mounted therein. Further, a copper ring 69 is mounted in the front opening 611 near the rear side for stopping the internal insulation member 62. The metal center pin 63 is angled. The front end of the horizontal segment of the metal center pin 63 is shaped like an axially split clamp. The rear end of the metal center pin 63 is set between the rear insulation member 68 and the internal insulation member 62. Thus, the PAL-type socket member 6 can be installed in a circuit board 602 conveniently.

The front insulation member 64 is a T-shaped member having a front extension portion 641 suspending in front of the copper ring 69 at a distance. The impedance element 65 is horizontally inserted through the internal insulation member 62 at an eccentric location, having the first end 651 thereof electrically connected to the copper ring 69. The metal contact sleeve 66 has the expanded end face 661 thereof kept in contact with the inner side of the front insulation member 64. The expanded end face 661 is also kept in contact with the second end 652 of the impedance element 65. The elastic member 67 is set between the rear insulation member 68 and the expanded end face 661 of the metal contact sleeve 66.

Referring to FIG. 18, when inserting a plug member 2 into the PAL-type socket member 6, the front insulation member 64 is forced to push the expanded end face 661 of the metal contact sleeve 66 against the elastic member 67, causing separation of the second end 652 of the impedance element 65 from the expanded end face 661 of the metal contact sleeve 66.

Figure 19:
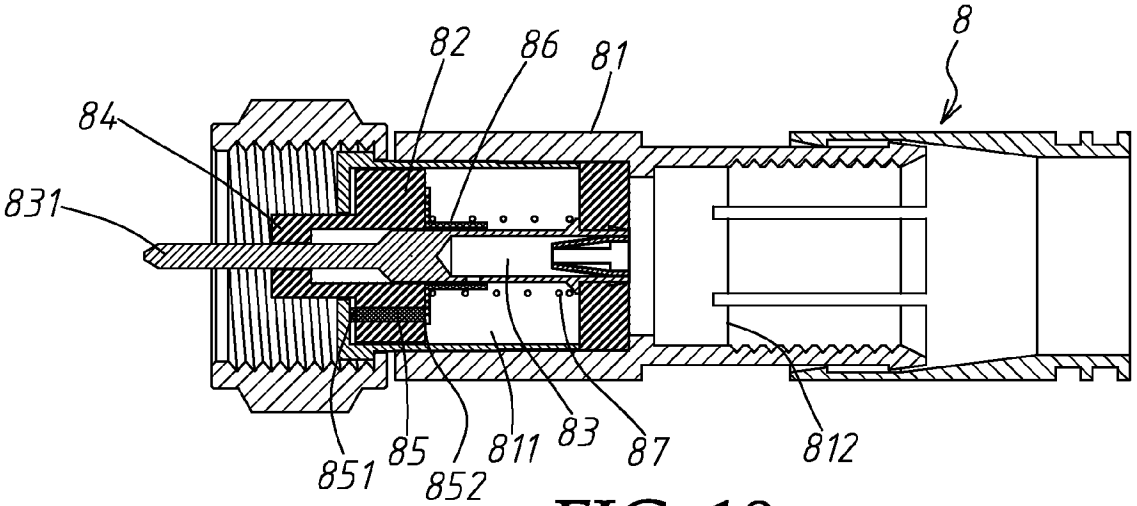
FIG. 19 is a sectional view of a plug member for RF connector in accordance with the present invention.
Figure 20:
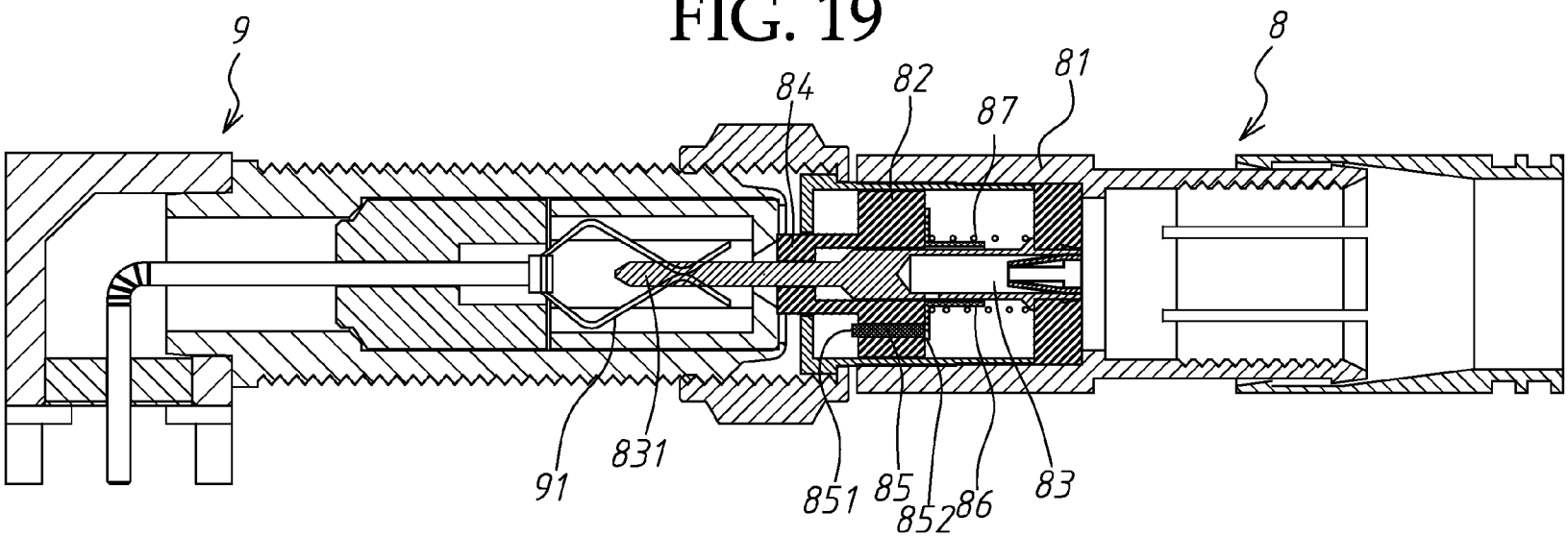
FIG. 20 corresponds to FIG. 19, showing a matching socket member connected thereto.

Further, the invention can also be applied to a plug member for RF connector. As shown in FIGS. 19 and 20, the plug member 8 comprises a metal casing 81, an internal insulation member 82, a metal center pin 83, a front insulation member 84, an impedance element 85, a metal contact sleeve 86 and an elastic member 87.

The metal casing 81 is a hollow cylindrical member, having a front opening 811 and a rear opening 812. The front end of the metal casing 81 is inserted into a socket member 9. The internal insulation member 82 is mounted in the metal casing 81. The metal center pin 83 is axially mounted in the metal casing 81 at the center and inserted through the internal insulation member 82, having the pointed front end 831 thereof inserted into the metal center pin 91 of the socket member 9 and electrically connected thereto, as shown in FIG. 20.

The front insulation member 84 is axially movably mounted in the front opening 811 of the metal casing 81 and sleeved onto the metal center pin 83. When inserting the plug member 8 into the socket member 9, the front insulation member 84 is moved axially. The impedance element 85 is mounted in the metal casing 81, having a first end 851 and an opposing second end 852. The metal contact sleeve 86 is electrically conductively sleeved onto the metal center pin 83 and movable with the front insulation member 84. The elastic member 87 is adapted for returning the front insulation member 84 after the front insulation member 84 having been moved.

Before insertion of the plug member 8 into the socket member 9, the first end 851 and second end 852 of the impedance element 85 are respectively electrically kept in contact with the metal casing 81 and the metal contact sleeve 86. Thus, the impedance element 85 provides a terminal effect to isolate external electromagnetic noises.

Referring to FIG. 20, when inserting the plug member 8 into the socket member 9, the front insulation member 84 and the metal contact sleeve 86 are forced to displace, thereby disconnecting the first end 851 or second end 852 of the impedance element 85 from the metal casing 81 or the metal contact sleeve 86, and therefore the terminal effect of the impedance element 85 is disappeared. FIG. 20 shows the first end 851 of the impedance element 85 disconnected from the metal casing 81.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A radio-frequency connector comprising: a socket member and a plug member electrically connectable to said socket member, wherein one of said socket member and said plug member has an impedance element mounted therein such that said impedance element is electrically connected to a metal casing and a metal center pin of the socket member or plug member carrying said impedance element when said plug member is disconnected from said socket member for causing said impedance element to provide a terminal effect to isolate external electromagnetic noises; said impedance element is separated from the metal casing and metal center pin of the socket member or plug member carrying said impedance element when said plug member is connected to said socket member;

wherein said plug member comprises:

a metal casing shaped like a hollow barrel, said metal casing having a front opening and an opposing rear opening, said front opening is configured to receive said socket member;

an internal insulation member mounted inside said metal casing;

a metal center pin mounted in the central axis of said metal casing and inserted through said internal insulation member, said metal center pin having a front end for connecting a metal center pin of said socket member electrically;

a front insulation member axially movably mounted inside the front opening of said metal casing and sleeved onto said metal center pin, said front insulation member being movable along said metal center pin upon insertion of said plug member into said socket member;

an impedance element mounted in said metal casing, said impedance element having a first end and an opposing second end;

a metal contact sleeve electrically conductively sleeved onto said metal center pin and axially movable with said front insulation member relative to said metal center pin; and an elastic member adapted for returning said front insulation member after displacement of said front insulation member;

the first end and second end of the impedance element of said socket member are respectively electrically connected to said metal casing and said metal contact sleeve for causing the impedance element to provide a terminal effect to isolate external electromagnetic noises when said plug member is disconnected from said socket member; inserting said plug member into said socket member causes said front insulation member and said metal contact sleeve to be moved to disconnect one of the first end and second end of the impedance element of said socket member from the metal casing or metal contact sleeve of said socket member.

2. The radio-frequency connector as claimed in claim 1, wherein said impedance element has one of a rod-shaped configuration and a strip-like configuration.

3. A radio-frequency connector comprising: a socket member and a plug member electrically connectable to said socket member, wherein one of said socket member and said plug member has an impedance element mounted therein such that said impedance element is electrically connected to a metal casing and a metal center pin of the socket member or plug member carrying said impedance element when said plug member is disconnected from said socket member for causing said impedance element to provide a terminal effect to isolate external electromagnetic noises; said impedance element is separated from the metal casing and metal center pin of the socket member or plug member carrying said impedance element when said plug member is connected to said socket member;

wherein said socket member comprises:

a metal casing shaped like a hollow barrel, said metal casing having a front opening and an opposing rear opening, said front opening is configured to receive said plug member;

an internal insulation member mounted inside said metal casing;

a metal center pin mounted in the central axis of said metal casing and inserted through said internal insulation member, said metal center pin having a front end for receiving a metal center pin of said plug member electrically;

a front insulation member axially movably mounted inside the front opening of said metal casing and sleeved onto said metal center pin, said front insulation member being movable along said metal center pin upon insertion of said plug member into said socket member;

an impedance element mounted in said metal casing, said impedance element having a first end and an opposing second end;

a metal contact sleeve electrically conductively sleeved onto said metal center pin and axially movable with said front insulation member relative to said metal center pin; and an elastic member adapted for returning said front insulation member after displacement of said front insulation member;

the first end and second end of the impedance element of said socket member are respectively electrically connected to said metal casing and said metal contact sleeve for causing the impedance element to provide a terminal effect to isolate external electromagnetic noises when said plug member is disconnected from said socket member; inserting said plug member into said socket member causes said front insulation member and said metal contact sleeve to be moved to disconnect one of the first end and second end of the impedance element of said socket member from the metal casing or metal contact sleeve of said socket member.

4. The radio-frequency connector as claimed in claim 3, wherein said metal casing of said socket member comprises a plurality of outer threads extending around the periphery thereof and a nut located on the periphery thereof on the middle for the formation of a F-type connector; said internal insulation member is mounted in the front opening of said metal casing; said metal casing has a rear insulation member mounted in the rear opening thereof for enabling said metal center pin to be connected between said internal insulation member and said rear insulation member.

5. The radio-frequency connector as claimed in claim 3, wherein said socket member is a MCX-type socket member having a metal T-type element perpendicularly inserted through the periphery of the metal casing thereof; said impedance element is horizontally embedded in said front insulation member, having the first end thereof electrically connected to said metal casing through said T-type element; said internal insulation member is mounted inside the rear opening of said metal casing; said elastic member is sleeved onto said metal center pin and set between said internal insulation member and the expended end face of said metal contact sleeve; when said plug member is inserted into said socket member, said front insulation member is moved along said metal center pin to force the expanded end face of said metal contact sleeve against said elastic member, causing disconnection of the first end of said impedance element from said metal T-type element.

6. The radio-frequency connector as claimed in claim 3, wherein said socket member is a N-type socket member; said metal casing comprises a plurality of outer threads extending around the periphery thereof, a grooved nut located on the periphery thereof on the middle, and a locating groove extending around the periphery; said impedance element is perpendicularly embedded in said metal casing, having the first end thereof electrically connected to said metal casing; said front insulation member comprises a cut extended from the periphery toward the center thereof for accommodating the second end of said impedance element and a through hole extended from said cut at right angles; said metal contact sleeve has an expanded end face located on one end thereof and kept in contact with an inner side of said front insulation member and a protruding strip extended from said expanded end face and engaged into the through hole of said front insulation member and kept in contact with the second end of said impedance element; said internal insulation member is mounted in the rear opening of said metal casing; said elastic member is set between said internal insulation member and the expanded end face of said metal contact sleeve; when said plug member is inserted into said socket member, said front insulation member is moved to push the expanded end face of said metal contact sleeve against said elastic member, causing separation of the second end of said impedance element from the protruding strip of said metal contact sleeve.

7. The radio-frequency connector as claimed in claim 3, wherein said socket member is a SMA type socket member; said metal casing comprises a plurality of outer threads extending around the periphery near a front end thereof, a nut located on the periphery thereof, a board member connection device located on a rear end thereof and stopped against said nut, and an inside annular flange disposed inside the front opening thereof for stopping said front insulation member; said metal center pin is angled; said internal insulation member is mounted in a rear open side of said board member connection device; said front insulation member has a front extension portion inserted through said inside annular flange of said metal casing; said impedance element is horizontally mounted in said front insulation member at an eccentric location, having the first end thereof electrically connected to said inside annular flange of said metal casing; said metal contact sleeve has an expanded end face located on one end thereof and stopped against an inner end of said front insulation member and the second end of said impedance element; said elastic member is sleeved onto a horizontal segment of said angled metal center pin and stopped against the expanded end face of said metal contact sleeve; when said plug member is inserted into said socket member, said front insulation member is forced to move said expanded end face of said metal contact sleeve against said elastic member, causing separation of the first end of said impedance element from said annular inside flange of said metal casing.

8. The radio-frequency connector as claimed in claim 3, wherein said socket member is a PAL-type socket member; said metal casing has a board member connection device located on a rear end thereof and a copper ring mounted in the front opening thereof for stopping said internal insulation member, said board member connection device having a rear insulation member mounted therein; said metal center pin is angled, having a front end thereof shaped like an axially split clamp and a rear end thereof set between said rear insulation member and said internal insulation member; said front insulation member is a T-shaped member having a front extension portion suspending in front of said copper ring at a distance; said impedance element is horizontally inserted through said internal insulation member at an eccentric location, having the first end thereof electrically connected to said copper ring; said metal contact sleeve comprises an expanded end face located on one end thereof and kept in contact with an inner side of said front insulation member and the second end of said impedance element; said elastic member is set between said rear insulation member and the expanded end face of said metal contact sleeve; when said plug member is inserted into said socket member, said front insulation member is forced to push the expanded end face of said metal contact sleeve against said elastic member, causing separation of the second end of said impedance element from the expanded end face of said metal contact sleeve.

9. The radio-frequency connector as claimed in claim 3, wherein said impedance element has one of a rod-shaped configuration and a strip-like configuration.

10. The radio-frequency connector as claimed in claim 3, wherein said metal center pin of said socket member has a collar extending around the periphery thereof; said metal contact sleeve has an expanded end face at one end thereof; said elastic member is stopped between said collar of said metal center pin and the expanded end face at one end of said metal contact sleeve.

11. The radio-frequency connector as claimed in claim 10, wherein said metal casing has a copper ring affixed to the front opening thereof; said front insulation member comprises a front extension portion inserted through said copper ring.

12. The radio-frequency connector as claimed in claim 11, wherein said impedance element is eccentrically embedded in said internal insulation member, having the first end and second end thereof respectively electrically kept in contact with said copper ring and said expanded end face of said metal contact sleeve.

13. The radio-frequency connector as claimed in claim 12, wherein said front insulation member is inserted through the center of said internal insulation member such that when said plug member is inserted into said socket member, said front insulation member is forced to move said expanded end face of said metal contact sleeve away from the second end of said impedance element against said elastic member.

14. The radio-frequency connector as claimed in claim 12, wherein said front insulation member is formed integral with said internal insulation member in a single piece such that when said plug member is inserted into said socket member, said front insulation member and said internal insulation member are moved to force said expanded end face of said metal contact sleeve against said elastic member, causing separation of the first end of said impedance element from said copper ring.

15. The radio-frequency connector as claimed in claim 14, wherein said socket member is an F-type socket member; said metal casing of said socket member has a board member connection device mounted on a rear side thereof; said metal center pin is angled.

16. The radio-frequency connector as claimed in claim 14, wherein said socket member is a F-type coaxial cable socket member; said metal casing of said socket member has a coaxial cable guide located on a rear end thereof.

* * * * *